US007987645B2

(12) United States Patent
Tinianov

(10) Patent No.: US 7,987,645 B2
(45) Date of Patent: Aug. 2, 2011

(54) NOISE ISOLATING UNDERLAYMENT

(75) Inventor: Brandon Tinianov, Santa Clara, CA (US)

(73) Assignee: Serious Materials, Inc., Sunnyvale, CA (US)

( * ) Notice: Subject to any disclaimer, the term of this patent is extended or adjusted under 35 U.S.C. 154(b) by 211 days.

(21) Appl. No.: 11/692,921

(22) Filed: Mar. 29, 2007

(65) Prior Publication Data

US 2008/0236097 A1 Oct. 2, 2008

(51) Int. Cl.
*E04F 15/22* (2006.01)

(52) U.S. Cl. ..... 52/403.1; 52/144; 428/156; 428/180; 181/290

(58) Field of Classification Search ..... 52/403.1, 52/472.92, 144, 302.3, 480, 472; 428/156, 428/158, 159, 160, 163, 167, 180; 472/92; 181/284, 286, 290, 294, 295
See application file for complete search history.

(56) References Cited

U.S. PATENT DOCUMENTS

| | | | | |
|---|---|---|---|---|
| 2,811,906 | A | 11/1957 | Chappell | |
| 2,956,785 | A * | 10/1960 | Riehl | 165/56 |
| 3,160,549 | A | 12/1964 | Caldwell et al. | |
| 3,215,225 | A | 11/1965 | Kirschner | |
| 3,336,710 | A | 8/1967 | Raynes | |
| 3,399,104 | A | 8/1968 | Ball, III et al. | |
| 3,424,270 | A | 1/1969 | Hartman et al. | |
| 3,462,899 | A | 8/1969 | Sherman | |
| 3,579,941 | A | 5/1971 | Tibbals | |
| 3,642,511 | A | 2/1972 | Cohn et al. | |
| 3,828,504 | A | 8/1974 | Egerborg et al. | |
| 4,003,752 | A | 1/1977 | Osohata et al. | |
| 4,112,176 | A | 9/1978 | Bailey | |
| 4,156,615 | A | 5/1979 | Cukier et al. | |
| 4,347,912 | A | 9/1982 | Flocke et al. | |
| 4,361,614 | A * | 11/1982 | Moffitt, Jr. | 428/138 |
| 4,375,516 | A | 3/1983 | Barrall | |
| 4,487,793 | A | 12/1984 | Haines et al. | |

(Continued)

FOREIGN PATENT DOCUMENTS

| | | |
|---|---|---|
| CA | 2219785 | 10/1996 |

(Continued)

OTHER PUBLICATIONS

"Green Glue is your soundproofing solution and noise reduction material", www.greengluecompany.com (2 pages).

(Continued)

*Primary Examiner* — Robert J Canfield
*Assistant Examiner* — Babajide Demuren
(74) *Attorney, Agent, or Firm* — Haynes and Boone, LLP

(57) ABSTRACT

A noise-reducing substrate for use in a flooring system which ha a subfloor and a floating floor upper layer. The substrate comprises a series of edge butted panels, each having a bottom surface, a top surface and side surfaces. A profile in the bottom surface of the substrate changes the substrate's effective stiffness improving the noise isolation of the substrate compared to the stiffness and noise isolation of the panel without the profile. Additionally, the profile reduces the weight of the panel, thereby reducing manufacturing and installation costs. Material hardness and profile flatness of the upper surface provide the strength and texture required to allow for installation of the floating floor layer without the need for an additional rigid backing material. Such a system greatly improves the impact noise reduction on floor/ceiling systems while keeping the installation cost low and adding little to the total system thickness.

31 Claims, 8 Drawing Sheets

U.S. PATENT DOCUMENTS 4,618,370 A 10/1986 Green et al.
4,642,951 A 2/1987 Mortimer
4,663,224 A 5/1987 Tabata et al.
4,678,515 A 7/1987 Green et al.
4,685,259 A 8/1987 Eberhart et al.
4,759,164 A 7/1988 Abendroth et al.
4,778,028 A 10/1988 Staley
4,786,543 A 11/1988 Ferm
4,840,515 A * 6/1989 Freese ..... 405/45
4,924,969 A 5/1990 L'Heureux
4,956,321 A 9/1990 Barrall
4,956,951 A * 9/1990 Kannankeril ..... 52/169.5
4,967,530 A 11/1990 Clunn
5,016,413 A 5/1991 Counihan
5,026,593 A 6/1991 O'Brien
5,033,247 A 7/1991 Clunn
5,052,161 A * 10/1991 Whitacre ..... 52/385
5,063,098 A 11/1991 Niwa et al.
5,110,660 A 5/1992 Wolf et al.
5,125,475 A 6/1992 Duchame et al.
5,158,612 A 10/1992 Savoly et al.
5,240,639 A 8/1993 Diez et al.
5,255,482 A * 10/1993 Whitacre ..... 52/390
5,256,223 A 10/1993 Alberts et al.
5,258,585 A 11/1993 Juriga
5,334,806 A 8/1994 Avery
5,342,465 A 8/1994 Bronowicki et al.
5,362,544 A * 11/1994 Reuben ..... 428/82
5,368,914 A 11/1994 Barrett
5,439,735 A 8/1995 Jamison
5,473,122 A 12/1995 Kodiyalam et al.
5,474,840 A 12/1995 Landin
5,502,931 A 4/1996 Munir
5,603,192 A 2/1997 Dickson
5,619,832 A * 4/1997 Myrvold ..... 52/403.1
5,629,503 A 5/1997 Thomasen
5,643,666 A 7/1997 Eckart et al.
5,664,397 A 9/1997 Holz
5,691,037 A 11/1997 McCutcheon et al.
5,695,867 A 12/1997 Saitoh et al.
5,768,841 A 6/1998 Swartz et al.
5,824,973 A 10/1998 Haines et al.
5,867,957 A 2/1999 Holtrop
5,910,082 A 6/1999 Bender et al.
5,945,208 A 8/1999 Richards et al.
5,954,497 A 9/1999 Cloud et al.
6,077,613 A 6/2000 Gaffigan
6,123,171 A 9/2000 McNett et al.
6,213,252 B1 * 4/2001 Ducharme ..... 181/293
6,240,704 B1 6/2001 Porter
6,266,427 B1 7/2001 Mathur
6,286,280 B1 9/2001 Fahmy et al.
6,290,021 B1 9/2001 Standgaard
6,309,985 B1 10/2001 Virnelson et al.
6,342,284 B1 1/2002 Yu
6,381,196 B1 4/2002 Hein et al.
6,389,771 B1 5/2002 Moller
6,443,256 B1 9/2002 Baig
6,623,840 B2 * 9/2003 Hainbach ..... 428/172
6,632,550 B1 10/2003 Yu et al.
6,676,744 B2 1/2004 Merkley et al.
6,699,426 B1 3/2004 Burke
6,715,241 B2 4/2004 Gelin et al.
6,758,305 B2 7/2004 Gelin et al.
6,790,520 B1 9/2004 Todd et al.
6,800,161 B2 10/2004 Takigawa
6,803,110 B2 10/2004 Drees et al.
6,815,049 B2 11/2004 Veramasuneni
6,822,033 B2 11/2004 Yu
6,825,137 B2 11/2004 Fu et al.
6,837,014 B2 * 1/2005 Virtanen ..... 52/390
6,877,585 B2 4/2005 Tinianov
6,913,667 B2 7/2005 Nudo et al.
6,920,723 B2 7/2005 Downey
6,941,720 B2 9/2005 Deford et al.
6,951,264 B2 * 10/2005 Byma et al. ..... 181/286
7,041,377 B2 5/2006 Miura et al.
7,068,033 B2 6/2006 Sellers et al.
7,181,891 B2 2/2007 Surace et al.
7,197,855 B2 4/2007 Della Pepa
2002/0081410 A1 * 6/2002 Buckwalter et al. ..... 428/40.1
2003/0154676 A1 * 8/2003 Schwartz ..... 52/391
2004/0016184 A1 1/2004 Huebsch et al.
2004/0168853 A1 9/2004 Gunasekera et al.
2004/0214008 A1 10/2004 Dobrusky et al.
2005/0006173 A1 * 1/2005 Albin, Jr. ..... 181/290
2005/0079314 A1 * 4/2005 Brodeur et al. ..... 428/71
2005/0103568 A1 5/2005 Sapoval et al.
2005/0106378 A1 * 5/2005 Rives et al. ..... 428/304.4
2005/0158517 A1 * 7/2005 Rives et al. ..... 428/158
2005/0263346 A1 * 12/2005 Nishimura ..... 181/290
2006/0048682 A1 3/2006 Wagh et al.
2006/0057345 A1 3/2006 Surace et al.
2006/0059806 A1 3/2006 Gosling et al.
2006/0108175 A1 5/2006 Surace et al.
2007/0094950 A1 5/2007 Surace et al.
2007/0107350 A1 5/2007 Surace et al.

FOREIGN PATENT DOCUMENTS

EP 58825 A1 * 9/1982
EP 206329 A2 * 12/1986
EP 1154087 B1 11/2001
FR 2568516 A1 * 2/1986
JP 09-203153 8/1997
WO WO 96/34261 10/1996
WO WO 97/19033 5/1997
WO WO 00/24690 5/2000

OTHER PUBLICATIONS

Acoustical: *A Sound Approach to Testing*, www.archest.com/pages (2 pages).

STC—*Sound Transmission Class—Discussion and Use*, www.sota.ca/stc_info.htm (3 pages).

ASTM International, Designation: C 1396/C 1396M-04, *Standard Specification for Gypsum Board* (7 pages).

Barbara C. Lippiatt, National Institute of Standards and Technology. BEES 3.0, "*Building for Environmental and Economic Sustainability Technical Manual and User Guide*", Oct. 2002, (198 pages).

Takada, et al., *Effect in Reducing Floor Impact Noise of Recycled Paper Damper Members*, Bulletin of Tokyo Metropolitan Industrial Technology Research Institute, No. 2 (1999) [certified English translation] (13 pages).

*Architectural Acoustics*, M. David Egan, J. Ross Publishing (Reprint 2007) p. 211; originally published McGraw-Hill, 1988 (5 pages).

Hastings, Mardi C.; Godfrey, Richard; Babcock, G. Madison, *Application of Small Panel Damping Measurements to Larger Walls*, Proc. SPIE vol. 2720, p. 70-76, Smart Structures and Materials 1996: Passive Damping and Isolation (7 pages).

van Vuure, A.W.; Verpoest, I., Ko, F.K., *Sandwich-Fabric Panels as Spacers in a Constrained Layer Structural Damping Application*, Composites Part B 32 (2001) 11-19, Elsevier Science Ltd. (9 pages).

Noise and Vibration Control, Revised Edition, pp. 306-315, Institute of Noise Control Engineering, 1988, Beranek, Leo L. (editor) (9 pages).

Noise and Vibration Control, Chapter Fourteen, Damping of Panels, Ungar, Eric E., pp. 434-473, McGraw-Hill, 1971, Beranek, Leo L. (editor) (7 pages).

Noise and Vibration Control Engineering, *Principles and Application*, pp. 466-479, John Wiley & Sons, 1992, Beranek, Leo L. and Ver, Istvan L. (editors) (9 pages).

Nashif, Ahid D.; Jones, David I. G.; Henderson, John P., *Vibration Damping*, pp. 290-305, John Wiley & Sons, 1985 (18 pages).

Architectural Acoustics, Principles and Practice, John Wiley & sons, 1992, Cavanaugh, William J. and Wilkes, Joseph A. (editors) (332 pages).

FIRE Resistance Design Manual, Sound Control, Gypsum Association, GA-600-94 ($14^{th}$ Ed.) (107 pages).

FIRE Resistance Design Manual, Sound Control, Gypsum Association, GA-600-97 ($15^{th}$ Ed.) (120 pages).

FIRE Resistance Design Manual, Sound Control, Gypsum Association, GA-600-2000 ($16^{th}$ Ed.) (139 pages).

Noxon, Arthur M., *The Chain is as Strong as its Weakest Link*, An article written for the first Hong Kong HiFi Show, 1993, Translated and Published in Chinese, http://www.acousticsciences.com/articles/chain.htm (7 pages).
*Quiet Lightweight Floor Systems*, Reprint from Sound and Vibration Magazine, Jul. 1992, by David A. Harris, Building & Acoustic Design Consultants (7 pages).
Joyal, Brian, *Constrained-Layer Systems Provide Weight-Efficient, High Level Damping* (4 pages).
Dynamat materials http://web.archive.org/web/20010525113753/www.admteschusa.com/Dynamat.html Jun. 12, 2007, ADM Tech—Dynamic Control (15 pages).
Noise Killer: Pro Damping Compound Materials http://www.tnt-audio.com/clinica/noise.html May 18, 2007, 1998 (3 pages).
Waybackmachine search results for Jan 1, 1996-Jun 12, 2007 (1 page).
Frankovich, David, *The Four-Fold Method of Noise and Vibration Control* (8 pages).
Renninger, Jennifer, *Understanding Damping Techniques for Noise and Vibration Control* (8 pages).
Unified Facilities Criteria (UFC) *Noise and Vibration Control*, UFC 3-450-01. May 15, 2000, Department of Defense (156 pages).
United States Gypsum, *Architectural and Construction Services, Design Data for Acousticians*, Feb. 1986 (4 pages).
*A Study of Techniques to Increase the Sound of Insulation of Building Elements*, Wyle Laboratories, Prepared for Dept. of Housing and Urban Development, Jun. 1973 (12 pages).
dB-Ply materials Sound Reducing Panels from Greenwood Forest Products, Inc., Apr. 24, 1997 (9 pages).
dB-Rock materials OMNI Products, Inc. (3 pages).
ASC WallDamp materials from Acoustic Sciences Corporation http://web.archive.org/web/20021013031149/www.asc-soundproof.com/index-walldamp...May 18, 2007 (21 pages).
Sounddown Viscoelastic Glue DG-A2, Soundown Corporation (2 pages).
Nordisk Akustik A/S materials, http://web.archive.org/web/200206240933724/www.nordisk.akustik.dk/html_uk/prod03.ht... Jun. 11, 2007 (4 pages).
IES 2000 *Dampening and Visocelastic Membranes* (Jul. 2, 2003) Atlanta.com/product (pp. 1-6).
Waybackmachine search results for Jan 1, 1996-May 3, 2006 (1 page).
"*Damping of plate flexural vibrations by means of viscoelastic laminae*" by D. Ross, E.E. Ungar, and E.M. Kerwin—Structural Damping, Section III, ASME, 1959, New York (41 pages).
Noise and Vibration Control Engineering: Principles and Applications, Edited by Leo Beranek and Instvan Ver, Chapter 11, John Wiley & Sons, Inc., 1992, 12 pp.
Handbook of Acoustical Measurements and Noise Control, Edited my Cyril Harris, Chapters 32 and 33, McGraw-Hill, Inc., 1991, 36 pp.
Vandersall , H. L., "*Intumescent Coating Systems, Their development and Chemistry*" J. Fire & Flammability, vol. 2 (Apr. 1971) pp. 97-140 (45 pages).
English Language Abstract, JP Patent First Publication No. 09-203153, Aug. 5, 1997, (2 pages).
*A Study of Techniques to Increase the Sound of Insulation of Building Elements*, Wyle Laboratories, Prepared for Dept. of Housing and Urban Development, Jun. 1973 (16 pages).
*Field Sound Insulation Evaluation of Load-Beating Sandwich Panels for Housing*, Final Report, Prepared by Robert E. Jones, Forest Products Laboratory, Forest Service, U.S. Department of Agriculture, Aug. 1975 (53 pages).
*Sound Studio Construction on a Budget*, F. Alton Evererst, McGraw-Hill, 1997 (7 pages).
*Wood Handbook/Wood as an Engineering Material*, United States Department of Agriculture, Forest Service, General Technical Report FPL-GTR-113, Mar. 1999 (24 pages).
*Transmission Loss of Plasterboard Walls* by T. D. Northwood, Building Research Note, Division of Building Research, National Research Counsel, Ottawa, Canada (10 pages).
*A Guide to Airborne, Impact, and Structureborne Noise Control in Multifamily Dwellings*, U. S. Department of Housing and Urban Development, Prepared for the National Bureau of Standards, Washington, D. C., Jan. 1963 (5 pages).
*Transmission Loss of Leaded Building Materials*, Paul B. Ostergaard, Richmond L. Cardinell, and Lewis S. Goodfriend, The Journal of the Acoustical Society of America, vol. 35, No. 6, Jun. 1963 (7 pages).
*Dictionary of Architecture & Construction 2200 illustrations*, Third Edition, Edited by Cyril M. Harris, Professor Emeritus of Architecture Columbia University, McGraw-Hill, 2000 (7 pages).
*Dictionary of Engineering Materials*, Harald Keller, Uwe Erb, Wiley-Interscience by John Wiley & Sons, Inc. 2004 (4 pages).
*Chamber Science and Technology Dictionary*, by Professor Peter M. B. Walker, W & R Chambers Ltd and Cambridge University Press, 1988 (3 pages).

* cited by examiner

| Cross sectional profile | Effective Spring Constant ($k_{eff,}$ Pa) | Isolation Efficiency at 160 Hz | Relative volume of substrate material |
|---|---|---|---|
| Continuous sheet (11 mm thick) | 1.19e7 | 90.1% | 100% |
| Slab (11 mm thick) w/ grooved bottom (3mm deep, 3mm wide, 6mm pitch, U shaped groove) | 9.41e6 | 92.0% | 85% |
| Slab (3 mm thick) w/ 8mm high rounded protuberances ($x^4$=40y) | 7.47e6 | 93.4% | 71% |
| Slab (3 mm thick) w/ 8mm high wide parabolic protuberances ($x^2$ = 3y) | 6.24e6 | 94.3% | 54% |
| Slab (3 mm thick) w/ 8mm high narrow parabolic protuberances ($x^2$ = 1y) | 2.08e6 | 97.4% | 54% |

Figure 6

NOISE ISOLATING UNDERLAYMENT

FIELD OF THE INVENTION

This invention relates to noise isolating material for use in flooring and in particular to a sound insulating material possessing the strength characteristics required to properly support the decorative top layer of the flooring and the dynamic stiffness required to best isolate impact noise.

BACKGROUND OF THE INVENTION

The demand for rigid decorative flooring materials such as ceramic and masonry tiles and wood laminate flooring in the construction industry has grown over recent years. These materials are, among other qualities, durable, easy to maintain, and attractive. However, despite their numerous desirable qualities, these materials typically exhibit poor acoustic properties with regard to structure-borne sound transmission. Specifically, the noises generated by footfalls or other periodic impacts are readily transmitted to other parts of the building—especially the rooms below. Poor sound or acoustic properties are extremely undesirable in all structures, but in particular in high-rise office buildings, hotels, apartments, and the like.

Impact noise isolation is a current building design issue as evidenced by the fact that almost all contemporary model building codes establish a minimum impact noise isolation between occupied living units. Actual acoustical performance is determined by test procedures developed by either the International Standards Organization (ISO) or the American Society of Testing and Materials (ASTM). Within North America, the ASTM test procedure is preferred. The specific ASTM Impact Sound Isolation tests are E492 and E 989. The single number rating generated by these test procedures is an impact isolation class or IIC. The various International Code Council model building codes require that floor/ceiling assemblies be designed to a minimum IIC rating of 50. Advisory agencies such as HUD and private real estate development corporations often recommend IIC performance of 60 or more for luxury dwellings. Typical floor/ceiling systems incorporating rigid decorative flooring materials fall below these requirements, delivering IIC ratings of 30-45. For this reason many resilient underlayment systems have been developed to improve the acoustic performance of floors.

In the prior art an underlayment layer was inserted between the floor slab or structural subfloor and the floor topping layer to improve impact noise isolation. (The terms "slab" and "subfloor" are used interchangeably herein to refer to both a floor slab and a structural subfloor as supporting structure.) These prior art underlayment layers are commonly manufactured as homogeneous substrates that can be rolled or laid onto the subfloor. Most of these materials consist of or include a uniform layer of cellular foam or rubber as disclosed in U.S. Pat. Nos. 2,811,906, 3,579,941, 4,112,176, 5,016,413 and 6,920,723. An example of such a substrate is shown in FIG. 1 from U.S. Pat. No. 6,920,723. Notably, most descriptions of these prior art structures incorrectly credit the cellular composition or resulting internal voids as an acoustic energy dissipating mechanism rather than correctly describing these features as reducing the underlayment's effective dynamic stiffness and thereby improving the impact isolation of the underlayment. If the underlayment material is soft or the void fraction high (resulting in an underlayment that is soft) then the installed sheet is unable to support tile or any other rigid topping material without allowing the tile or rigid topping material to crack. In such cases, a rigid topping layer such as 6-20 mm OSB or plywood is installed on top of the underlayment layer before installing the rigid decorative flooring material. This additional step adds to the installed cost and overall height of the system. In each case, the two opposite surfaces of the homogeneous underlayment layer are parallel and flat. Commercial examples of such underlayment materials include Regupol-QT by Dodge-Regupol of Lancaster, Pa., QuietFoam® underlayment by Quiet Solution of Sunnyvale, Calif., and ETHAFOAM from Dow Chemical of Midland, Mich.

Thin, fibrous mats can also be characterized as homogeneous underlayments. Although such mats lack a cellular structure or predictable void fraction, their material characteristics and limitations are the same. A commercial example of a thin fibrous mat underlayment is ENKASONIC from Akzo Industrial Systems Company of Asheville, N.C.

Other prior art underlayment layers use a homogeneous material that is profiled or coped with engineered voids to reduce the effective dynamic stiffness of the underlayment. Examples are described in U.S. Pat. Nos. 4,759,164, 5,110,660, and 6,213,252. U.S. Pat. Nos. 4,759,164, and 6,213,252 describe a rubber sheet with a bottom surface that includes parallel channels that reduce the overall surface contact area of the underlayment from 100% to a range between 15 and 75%. For example, FIG. 2 from U.S. Pat. No. 5,110,660 shows a rubber mat wherein cavities and intersecting hollow channels (i.e. parallel grooves) are designed to impart the benefits of a soft rubber to a harder base material. A potential problem with the underlayment described by U.S. Pat. No. 6,213,252 is that the parallel grooves may inadvertently align with the parallel edges of the overlying ceramic tile or wood flooring planks allowing the system to form a fissure at the grout, across a tile, or between wood panels. A commercial example of such an underlayment is Neutra-Phone by Royal Mat International, Inc. of Quebec, Canada. In addition, because the grooves penetrate into the underlayment only a small distance relative to the thickness of the underlayment, the dynamic stiffness of the underlayment is not significantly changed from the dynamic stiffness of the bulk material.

A third prior art structure is a composite underlayment. U.S. Pat. Nos. 4,685,259, 5,867,957 and 6,077,613 describe underlayments that involve multiple layers of dissimilar materials to create a composite laminated structure. Such designs incorporate a soft material with a low relative dynamic stiffness and good noise isolation together with a hard material adhered to the top and or bottom surface(s). Though the hard material exhibits poor noise isolation, it allows the rigid decorative flooring material to be directly installed over the underlayment. A more complicated underlayment manufacturing process is exchanged for a more cost effective installation method. Commercial examples of such underlayments include KINETICS Type SR Floorboard from Kinetics Noise Control of Dublin, Ohio and PCI-Polysilent from ChemRex of Minneapolis, Minn.

Thus many underlayments exist for reducing impact noise transmission. Although homogeneous mats exist, they must be unacceptably thin and/or rigid to allow direct installation of an overlaying rigid decorative layer. However, improved impact noise isolation via lower dynamic stiffness and greater mat thickness are structurally insufficient to allow a decorative topping layer such as tile to be directly applied to the underlayment. Without the additional support of a rigid top surface layer, the overlaying tiles or laminated flooring would crack and deform as pressure is applied. The introduction of the support layer further adds to the height requirements, resulting in greater expense.

It would, therefore, be beneficial to provide a noise isolating underlayment which provides adequate acoustical performance while providing the structural support necessary to support the tiles and laminated wood flooring. It would also be beneficial to provide such properties while minimizing the height required for the insulating member.

BRIEF SUMMARY OF THE INVENTION

The present invention provides an impact noise isolating underlayment having exceptional performance with an acceptable thickness for use with rigid decorative flooring including tile and laminated wood flooring and the like. As a feature of the invention, the isolation enhancing profile is oriented across the bottom surface of the underlayment so as not to allow possible alignment of one or more characteristics of the profile with the edges of any rigid decorative tile or plank. As an additional feature of the invention, improved impact noise isolating properties of the underlayment are provided compared to the prior art while maintaining the strength characteristics required to be used without an additional structural layer in such a flooring system. More specifically, in accordance with this invention, a noise isolating substrate is provided as an underlayment in a flooring structure including a subfloor. The substrate comprises a solid resilient material with a bottom surface sized to cover a given surface area, a top surface, and side edges. The bottom surface is provided with regularly arrayed knobs or protuberances whereby only a portion of the bottom surface is in contact with the subfloor. The surface ratio of the portion of bottom surface in contact with the subfloor to the given surface area covered by the bottom surface ranges from 15 to 50%, preferably from 15 to 35% and more preferably from 15 to 25%. It has been found that by reducing the portion of the bottom surface in contact with the subfloor the effective dynamic stiffness of the underlayment is lowered and thus the structure-borne energy which is transferred by the flooring structure when an object strikes the top floor surface is reduced. The resulting noise isolation of the overall flooring system structure is greatly improved.

In accordance with one embodiment of the invention, the resilient material used for the underlayment may be recycled rubber such as recycled tires although other types of rubber can also be used alone or in combination.

In this embodiment the substrate may have a thickness ranging between 1/64" and 1" and more particularly between 1/4" and 3/8" although other thickness may also be used.

Other objects, features and advantages of the present invention will be apparent upon reading the following written description together with the accompanying drawing.

BRIEF DESCRIPTION OF THE SEVERAL VIEWS OF THE DRAWINGS

FIG. 6 is a table comparing the performance and relative weight of several floor underlayment systems.

DETAILED DESCRIPTION OF THE EMBODIMENT SHOWN

The following written description is illustrative only and not limiting. The performance of an isolation system is best characterized by its isolation efficiency, I, which is given by I=1−T. The transmissibility, T, indicates the fraction of the energy of the disturbing motion, in this case impact noise, that is transmitted across the assembly. Therefore, the isolation efficiency indicates the fraction by which the transmitted disturbance energy is less than the energy of the excitation noise. Isolation efficiency can be expressed as a percent. If the transmissibility is 0.0075, the isolation efficiency is 0.9925 or 99.25% efficient. 99.25% of the energy does not get through the system.

Figure 1:
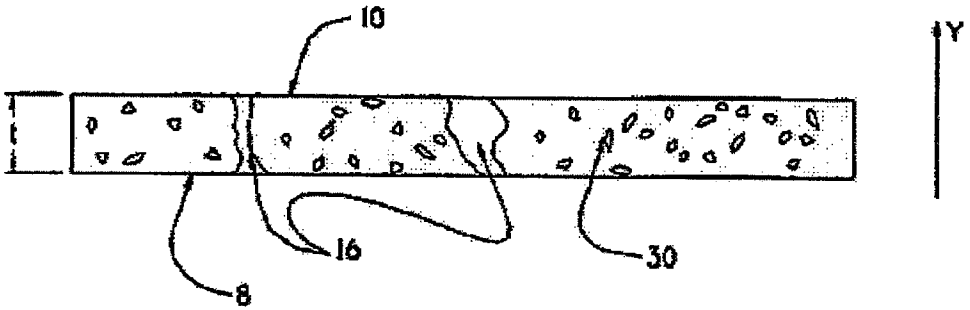
Figure 1 (PRIOR ART)
FIG. 1 is a cross sectional view of a continuous prior art slab substrate reproduced from FIG. 2 of U.S. Pat. No. 6,920,723.
Figure 2:
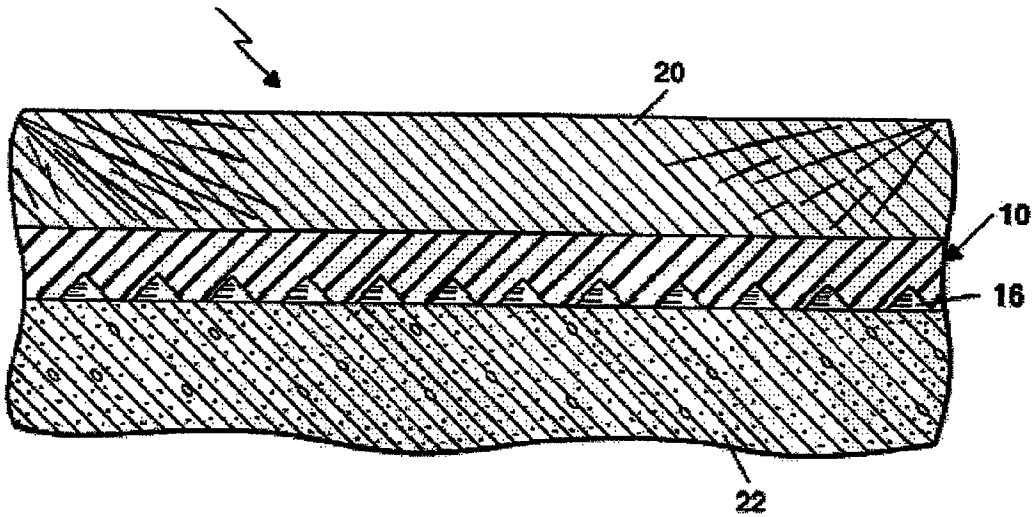
Figure 2 (PRIOR ART)
FIG. 2 is a cross sectional view of a grooved prior art slab substrate reproduced from FIG. 2 of U.S. Pat. No. 6,213,252.
Figure 3:
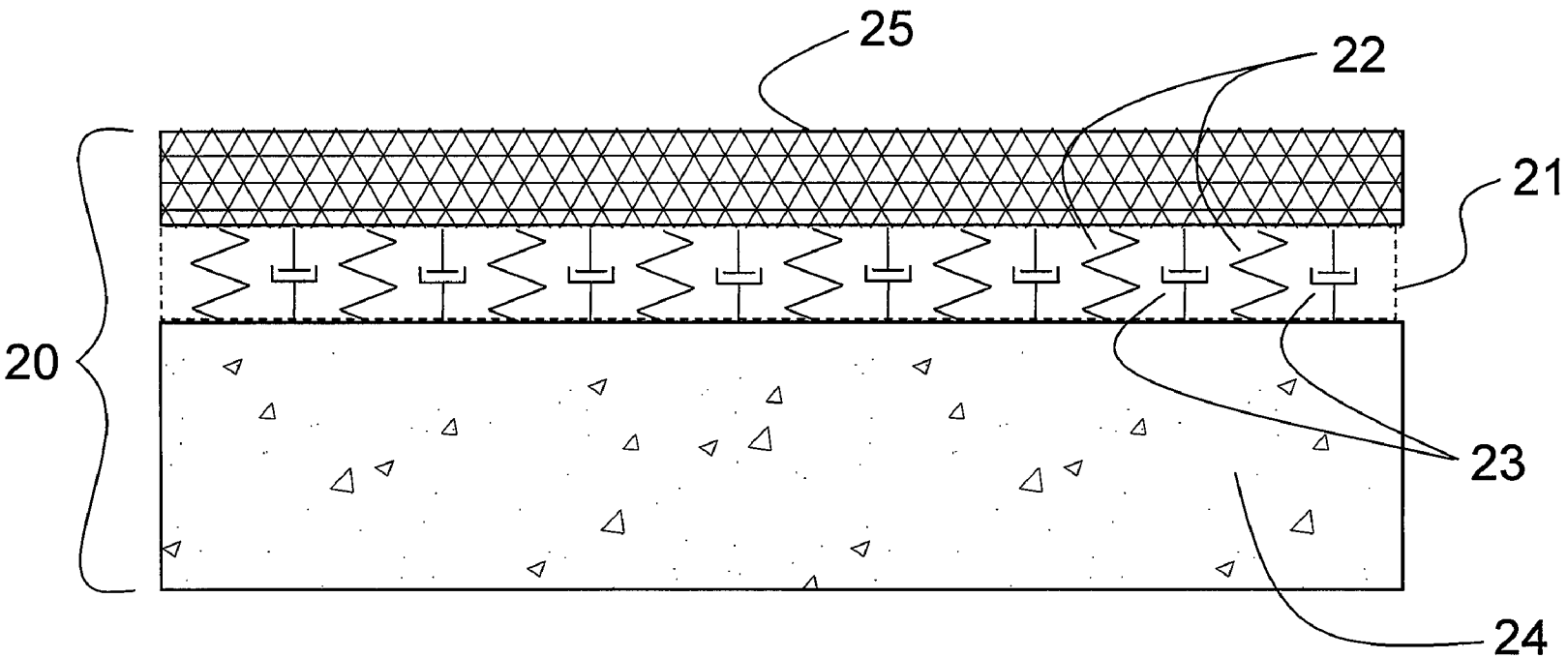
FIG. 3 is an enlarged cross sectional schematic showing a plurality of discrete springs and dashpots representing the distributed resistance and resilience of a resilient underlayment positioned between a subfloor and a topping layer.

Transmissibility may be calculated by the following equation:

$$T = \sqrt{\frac{1 + (2 \cdot \zeta \cdot r)^2}{(1 - r^2)^2 + (2 \cdot \zeta \cdot r)^2}} \qquad \text{Eq. 1}$$

where $r = f_d/f_n$ is the ratio of the frequency of the disturbance to that of the natural frequency of the mass-spring system and $\zeta$ is the damping ratio. FIG. 3 represents the flooring system 20 schematically where the underlayment 21 may be represented by a series of springs 22 and dashpots 23 between a stationary subfloor 24 and a floating mass 25. In practical isolation arrangements, the damping ratio is typically very small, ($\zeta$<0.1) and is neglected as a practical design variable. The natural frequency of the system is given by $$2 \cdot \pi fn = \sqrt{\frac{k}{m}} \quad \text{Eq. 2}$$

where k is the spring constant of the underlayment and m is the mass of the layers above the underlayment including wood, cement, and any decorative flooring. For a bulk elastomer such as rubber, the spring constant may be calculated by $$k = \frac{A \cdot E}{h} \quad \text{Eq 3}$$

where A is the area of the elastomer, E is the Young's Modulus of the elastomer, and h is the elastomer's thickness.

Noise with a frequency at or below that of the natural frequency of the system is not isolated by the system and may in fact be amplified at the natural frequency. Such an isolator system has an isolation efficiency of 0%. For that reason, isolation systems are designed with the lowest natural frequency practically possible so that all of the typically occurring noises are higher in frequency than the natural frequency and are attenuated to some degree. In fact, the goal of a resilient floor system is to design the system so that problem noises are as far above the natural frequency as possible. This approach will maximize the performance of the system.

As one can see in Equation 2, the natural frequency $f_n$ and the spring constant of the isolator are directly proportional. For a given mass (floor topping, etc), if the spring becomes stiffer, the natural frequency proportional to the square root of the spring constant increases and the isolation of the system suffers.

Previous inventions such as U.S. Pat. No. 6,920,723 have relied upon the properties of the bulk material to achieve isolation. Other inventions have made slight modifications to the bulk material by providing a short groove pattern on the bottom surface of the underlayment but the resulting system approximates the performance of an underlayment (i.e. an "isolator") without the grooves. In accordance with this invention, using the principles described above, the isolation provided by an underlayment is improved without changing the elastomer material properties or other elements of the system.

Figures 4A, 4B, 4C:
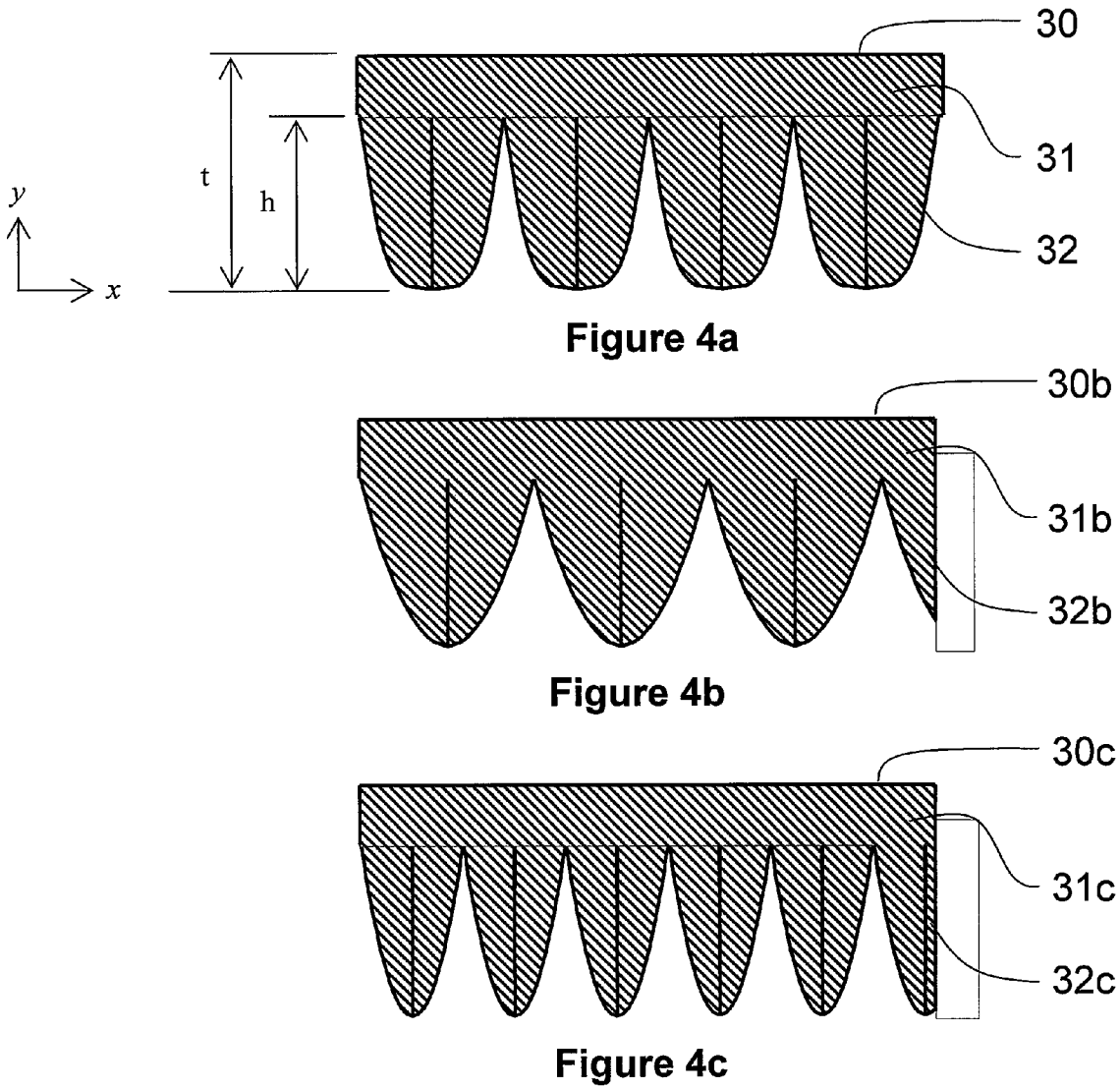
FIG. 4*a* is an enlarged cross sectional view of the substrate of an underlayment in accordance with this invention with a bottom profile of rounded columns.
FIG. 4*b* is an enlarged cross sectional view of a substrate of an underlayment in accordance with this invention with a bottom profile of wide parabolic cones.
FIG. 4*c* is an enlarged cross sectional view of a substrate of an underlayment in accordance with this invention with a bottom profile of narrow parabolic cones.

FIGS. 4*a*, 4*b*, and 4*c* show embodiments of the present invention whereby the isolation underlayment 30 is configured so that in cross section its top section and upper surface 31 are continuous and flat to accept a decorative floor topping. However, in accordance with this invention, the bottom section and bottom surface of the substrate 30 is formed as a series of adjacent, rounded cones 32. The two described sections and surfaces are simultaneously formed in a single mold so that there is no added expense of manufacture compared to the prior art underlayments. In one embodiment underlayment 30 is made of rubber and the properties of the rubber are chosen so that the upper section 31 has the required flexural strength to support ceramic or stone tile and laminated flooring systems without additional support materials or layers.

The profiled lower section 32 is designed to lower the effective spring constant of the stiff elastomer. This is accomplished by reducing the cross sectional area of the profile along the vertical axis of the underlayment 30. This profiling feature has the added benefit that as the cross sectional cone area per unit of underlayment area is reduced, less material is required to produce the underlayment. This will result in an underlayment that is less expensive to manufacture and has lower weight per unit area of floor covered. Such a weight improvement will aid both transportation and installation costs. Also, because in some embodiments the profiles are arranged in a staggered array, there are no grooves or straight lines of material weakness as present in previous inventions.

Figure 5:
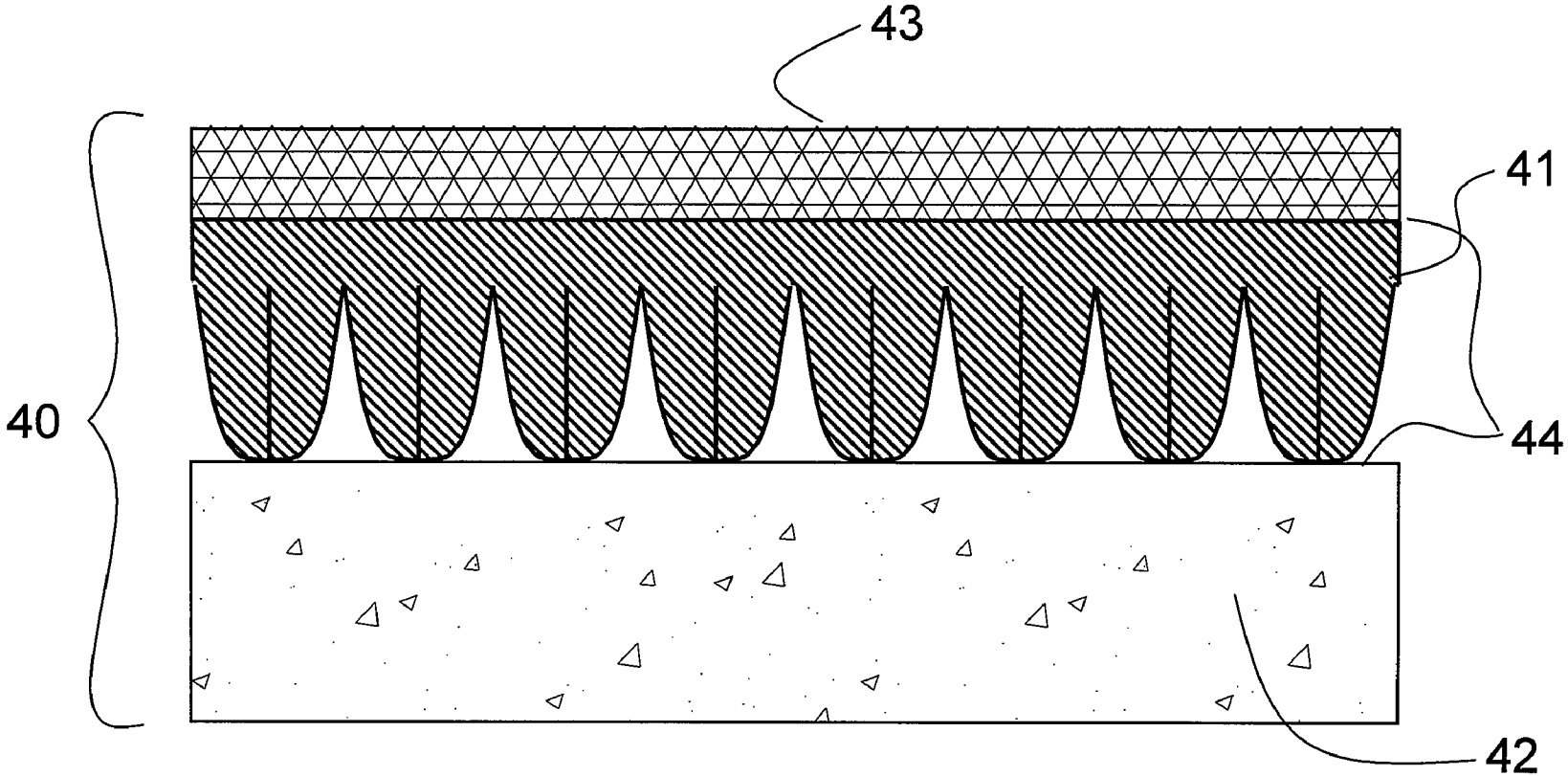
FIG. 5 is a cross sectional view of a flooring structure incorporating an underlayment similar to that shown in FIG. 1.

In the present embodiment, three conic profiles were numerically modeled to predict their advantages over the prior art. FIG. 4*a* illustrates a cone profile described by the mathematical formula $x^4=40y$, with axes as shown in the figure. This curve is rotated about the center axis and yields a series of rounded protuberances (columns in appearance). FIG. 4*b* illustrates a cone profile described by the mathematical formula $x^2=3y$ which is likewise rotated to form an array of protuberances (broad cones in appearance). FIG. 4*c* illustrates a cone profile described by the mathematical formula $x^2=y$ which is likewise rotated to form an array of narrow protuberances (cones in appearance). The underlayment would be arranged in a flooring system 40 as shown in FIG. 5 where 41 is the underlayment layer, 43 is the rigid floor topping and 42 is the subfloor or slab.

These profiles can be modeled for a practical material and geometry to quantify their improvements over the prior art. Modeling a typical floor system with an underlayment thickness of 11 mm, a common Young's modulus of rubber of $2\times10^6$ Pa, and a floor topping mass of 500 kg/m$^2$, the comparative systems have the results shown in FIG. 6. The isolation efficiency was calculated at a single frequency of 160 Hz. This frequency was chosen because it is a typical frequency of isolation failure for traditional floor ceiling systems.

| Cross sectional profile | Effective Spring Constant ($k_{eff}$, Pa) | Isolation Efficiency at 160 Hz | Relative volume of material |
|---|---|---|---|
| Continuous sheet | 1.19e7 | 90.1% | 100% |
| Slab (11 mm thick) | 9.41e6 | 92.0% | 85% |
| W/ grooved bottom (3 mm deep, 3 mm wide, 6 mm pitch) | | | |
| U-shape groove | | | |
| Rounded column ($x^4 = 40y$) | 7.47e6 | 93.4% | 71% |
| Wide Parabola ($x^2 = 3y$) | 6.24e6 | 94.3% | 54% |
| Narrow Parabola ($x^2 = 1y$) | 2.08e6 | 97.4% | 54% |

The incorporation of the profiled bottom section offers two performance advantages over the prior art. The increase in isolation efficiency at 160 Hz is up to 7.3% better than a continuous sheet of the same material and 5.4% better than a grooved underlayment of similar characteristics. Further, the proposed underlayment is 46% lighter that the continuous sheet and 36.5% lighter than the grooved sheet.

FIG. 5 shows, a flooring system 40 according to the present invention. The flooring system 40 has a base or subfloor 42. The subfloor 42 is an integral part of the building or structure and can be a concrete slab, plywood floor, or any other known material commonly used in the building industry. Positioned above the subfloor is a noise isolating substrate 41 and decorative top layer 43. The noise isolating substrate 41 may be affixed to the subfloor 42 and/or the decorative top layer 43 by means of mastic or glue layers 44 but such layers are not required.

The decorative top layer may be wood, linoleum, ceramic tile, carpet, or any other known flooring. Individual components of the decorative top layer 43 are positioned in place and secured to each other by frictional engagement, glue, grout, or other conventional means. As decorative flooring is commonly used, further explanation of the specifics relating to the decorative top layer 43 is not provided.

In the embodiments presented, the substrate 41 is manufactured from recycled rubber. Although the embodiment shown has a large percentage of styrene-butadiene rubber therein, the substrate 6 can be made of SBR rubber, other rubbers, or any combination thereof.

As shown in FIG. 5, the substrate 41 may or may not be glued or secured to the subfloor 42. If glue or adhesive or the like is to be used, the glue is generally applied to the subfloor prior to the substrate being finally positioned thereon. As the substrate 41 is in the form of interlocking panels, the weight of the panels and their frictional interface with the subfloor is generally sufficient to maintain the substrate in position, thereby eliminating the need for glue or the like.

With the substrate 41 properly positioned on the subfloor 42, the decorative top layer 43 can be installed. Depending on the material used for the decorative top layer, the material may or may not be glued or secured to the substrate. If glue or adhesive 44 is to be used, the glue is generally applied in small areas and the decorative top layer is installed thereon. This process is repeated until the entire decorative top layer is installed.

The substrate 41 of the present invention is configured to achieve noise isolation and meet strength requirements with a relatively thin cross section and without the need for an additional support member. When the substrate 41 is manufactured from rubber as described above, the rubber provides adequate structural integrity and does not require additional support members. Moreover, since the thickness of the substrate can be minimized to accommodate the particular application, the use of the substrate minimizes the overall height of the flooring system. This can be an extremely important factor in reducing building construction costs. When compared with conventional flooring systems, the use of the flooring system described herein can improve the floor efficiency up to 7% and reduce the weight of the underlayment 41 over 40%. As the thickness of substrate 41 is minimized and as no additional members are required, the use of the substrate 41 reduces the flooring structure's height and thus the space required for the floor structure. This reduction of height required for the flooring system is particularly significant in multi-story or high rise buildings. In these buildings, a reduction of a meter or less in height reduces the amount of building material used and is a significant cost savings.

Figure 7:
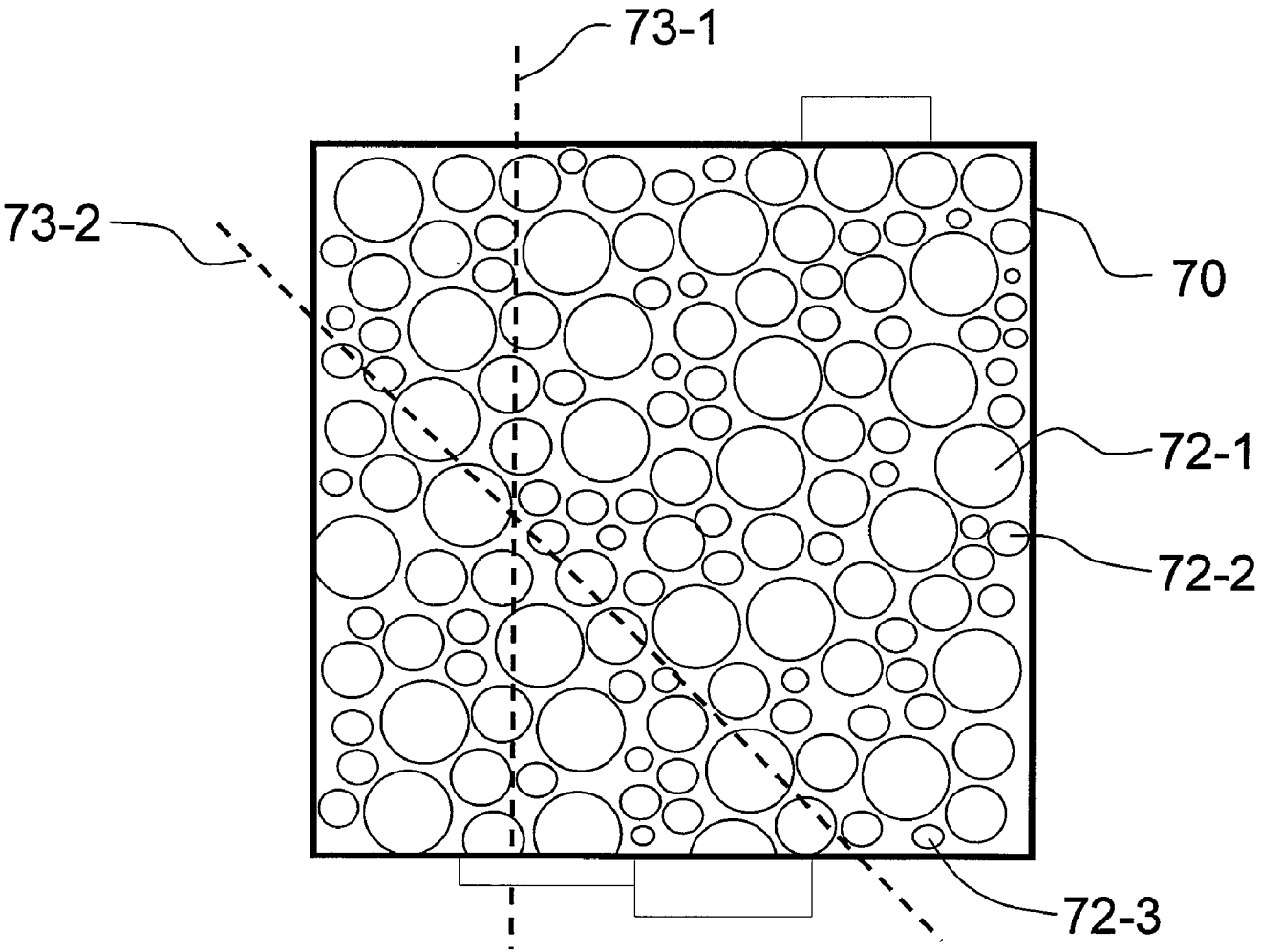
FIG. 7 shows a plan view from the bottom of an underlayment of protuberances extending from the bottom surface of the underlayment, each protuberance having a round cross-section where the cross-section is taken in a plane parallel to the top surface of the underlayment and the cross-section of each protuberance taken at any selected elevation along the protuberance having a diameter which can vary within a selected range of diameters.

FIG. 7 shows an underlayment 70 having protuberances such as 72-1, 72-2, and 72-3, extending from the bottom surface of the underlayment. The cross-sections of the protuberances taken in a plane parallel to the top surface of the underlayment are all circular but of differing diameters. The protuberances are arranged randomly so that no clear channel or groove extends from one side of the underlayment to the other parallel side of the underlayment. This is shown by line 73-1 running vertically in FIG. 7 across the bottom surface of underlayment 70 and by line 73-2 running at an angle across the bottom surface of the underlayment. Since these lines intersect protuberances, clearly no groove or channel exists extending straight across underlayment 70.

Underlayment 70 is fabricated of a selected rubber material as described above in such a manner that the bending stiffness of the upper portion of the underlayment (that is the portion of the underlayment from which the protuberances shown in plan view in FIG. 70 extend) is such that underlayment will not significantly bend when loads are placed upon it, thereby preventing any tiles or other flooring mounted on the top surface of underlayment 70 from cracking or breaking.

Figure 8:
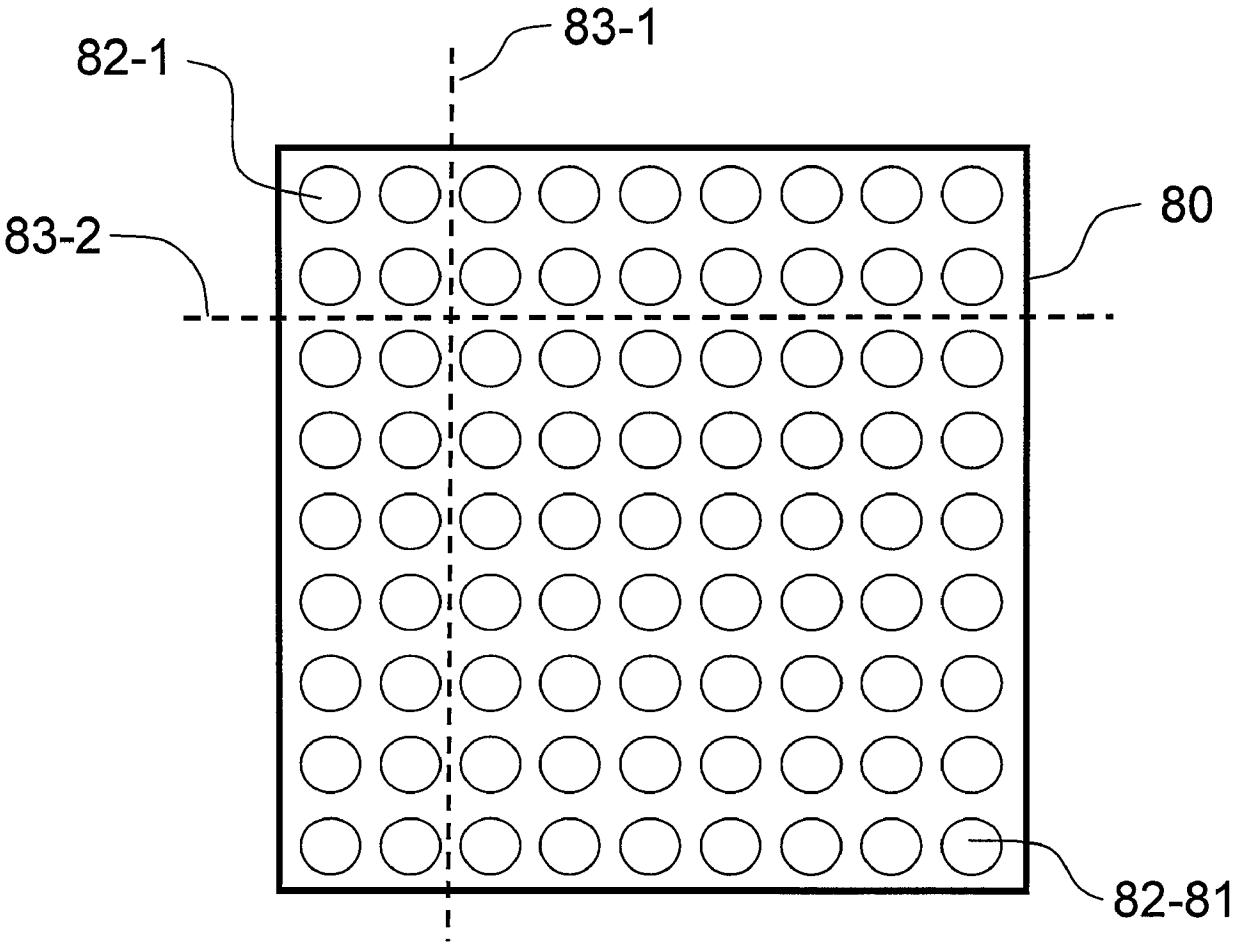
FIG. 8 shows protuberances extending from the bottom surface of the underlayment arranged in rows and columns, each protuberance having a cross-section taken in a plane perpendicular to the top surface of the underlayment which is identical in size to the cross-sections of the other protuberances.

Underlayment 80 shown in bottom plan view in FIG. 8 includes a plurality of identically shaped protuberances which extend from the bottom surface of the top portion of underlayment 80. As shown in FIG. 8, protuberances 82-1 to 82-81 are all of the same construction and have the same circular cross-section in a plane parallel to the top surface of underlayment 80. As shown by the straight lines 83-1 and 83-2, channels exist between the columns and rows of protuberances which allow a continuous void or clear channel to extend from one side of the underlayment to the other parallel side of the underlayment. As with the other underlayments disclosed and described herein, the material used to fabricate underlayment 80 has a bending stiffness in the upper portion of the underlayment from which the protuberances **82-*i* (where i is an index given by $1 \leqq i \leqq N$ where N is the number of protuberances on the underlayment), such that the underlayment will not significantly bend, thereby preventing any flooring materials such as tiles or wood mounted on the top surface of the underlayment 80** from cracking or breaking.

Figure 9:
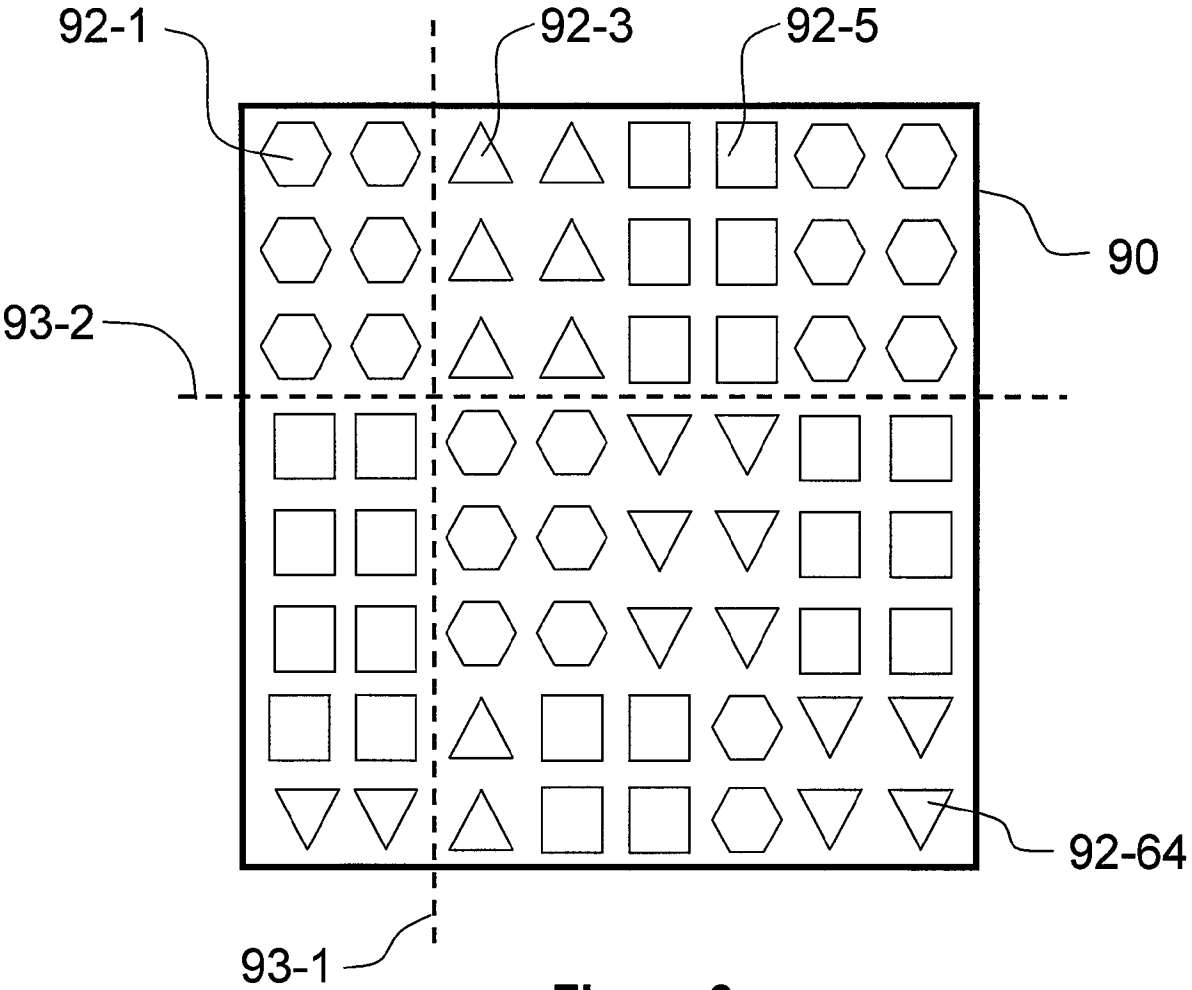
FIG. 9 shows an embodiment of this invention wherein protuberances of varying cross-sections are arranged in rows and columns and extend from the bottom surface of the underlayment.

FIG. 9 shows an underlayment 90 having a plurality of protuberances 92-1 to 92-64 of varying cross-sectional shapes where each cross-section again is taken in a plane parallel to the top surface of underlayment 90. Protuberance 92-1 thus has a polygonal cross-section, protuberance 92-3 has a triangular cross-section and protuberance 92-5 has a square cross-section. Of course other cross-sectional shapes can also be used including irregular and randomly generated cross-sectional shapes. The protuberances **92-*i* (where i is defined above) are arranged in rows and columns. However, such protuberances can also be arranged randomly on the bottom surface of underlayment 90 such that no clear channel or groove extends from one side of underlayment 90 to the other parallel side of underlayment 90. Such a random configuration is shown in FIG. 7 with protuberances all having different circular cross-sections in a plane parallel to the top surface of the underlayment 70. Protuberances having different cross-sections in a plane parallel to the top surface of the underlayment 70, 80 or 90 can, of course, be used in accordance with this invention. The material used to form underlayment 90 has a high enough bending stiffness (i.e., flexural strength) of the upper portion of underlayment 90 such that underlayment 90 will not significantly bend thereby preventing any flooring material such as tiles or wood mounted on the top surface of the underlayment 90** from cracking or breaking.

As a feature of some embodiments of the invention, the protuberances from the bottom of the underlayment are arranged in a non-symmetric manner such that no grooves or channels in the bottom layer are aligned along a straight line. As another feature of some embodiments of this invention, the protuberances from the bottom section of the underlayment can have cross sections in a plane parallel to the top surface of the underlayment with different diameters or dimensions although the protuberances are formed with the same height so as to insure that all protuberances contact the substructure when the underlayment is placed on the substructure. Note that the cross section in a plane parallel to the underlayment's top surface of each protuberance will vary in size as a function of the location of the cross section on the vertical center axis of the protuberance (the center axis extends perpendicular to the underlayment's top surface) and will also vary in size from protuberance to protuberance. Thus some embodiments of this invention will have protuberances on the bottom surface of the underlayment all of the same height but with different dimensions at the places where the protuberances attach to the underlayment.

While the protuberances as shown in FIGS. 4*a*, 4*b*, 4*c* and 6 have circular cross sections in one embodiment, the protuberances can have cross-sections of other shapes in other embodiments. For example, protuberances with mixed cross sectional shapes in a plane parallel to the underlayment's top surface can also be used on the bottom surface of the underlayment.

While the protuberances shown in FIG. 7 all have circular cross sections, the protuberances also could have triangular or polygonal or even random cross sections. Again however, the protuberances would be aligned such that no straight channel or groove would extend from one side of the underlayment to the other side between protuberances.

When the underlayment is placed on the subfloor, the protuberances shown in the structures of FIGS. 4*a*, 4*b*, 4*c*, 6, 7, 8 and 9 will all have their bottom portions in contact with the subfloor. As a feature of this invention, certain embodiments of this invention have the bottom of each protuberance curved such that theoretically only a point contact is made by each protuberance to the subfloor on which the underlayment is placed. However in reality, the protuberances have a Young's Modulus and a spring constant such that the weight of the underlayment causes the contact to occupy an area rather than to be just a point contact. Thus the bottom portions or exposed ends of the protuberances will be distorted by the weight of the underlayment and the overlaying flooring material. The contact of each underlayment protuberance to the subfloor will not be merely a tangential contact point but rather will be a flat portion of the exposed but distorted bottom region of each protuberance. The area of each protuberance in actual direct contact with the subfloor may vary from protuberance to protuberance. The sum of these areas is the total contact area of the underlayment to the subfloor. The amount of distortion or bulging of each protuberance to form the contact area when the underlayment is placed on the subfloor will depend on the Young's Modulus of the material making up the underlayment. This bulging is determined by the Poisson ratio associated with the material of which the protuberance is made. This material will, of course, be the same throughout the whole underlayment in one embodiment. However, other embodiments may have different materials in the underlayment, such that one material comprises the top portion of the underlayment and another material or combination of materials comprises the protuberances from the underlayment. The top portion of the underlayment is meant to be that portion from which the protuberances extend. Use of the words "top" and "bottom" herein refers to the surfaces of the underlayment as oriented when the underlayment is placed on a floor.

The embodiments of FIGS. 8 and 9 of this invention have the protuberances from the bottom surface of the underlayment aligned in rows and columns such that channels or grooves across the bottom surface of the underlayment extend straight from one side to the other parallel side of the underlayment. Such channels form an X and Y configuration on the bottom of the underlayment. However, the protuberances are arranged so that the pitch of adjacent rows or of adjacent columns of the protuberances ensure that the edges of tiles or of other flooring material to be formed on the top surface of the underlayment will not lie over the channels between the protuberances.

As shown in the structure of FIG. 9, although the orthogonally arranged protuberances in rows and columns will generally all have the same cross sectional appearance, this is not necessary. As shown in FIG. 9, an orthogonal protuberance structure can also be made up of protuberances with different cross sectional shapes so long as the other dimensions of the protuberances are such as to allow clear channels between adjacent rows and also between adjacent columns of protuberances.

In another embodiment of this invention, the grooves or spaces between protuberances are filled with a low modulus material to make easier the handling and stacking of the underlayments. Such low modulus material could be a rubber material or a combination of materials having a desired modulus of elasticity.

The foregoing illustrates some of the possibilities for practicing the invention. Many other embodiments are possible within the scope and spirit of the invention. The foregoing description is illustrative rather than limiting and the scope of the invention is given by the appended claims together with their full range of equivalents.

What is claimed is:

1. An underlayment for use in a flooring system, said underlayment having two surfaces where the first surface is flat and the second surface is profiled with an array of rounded cones; said underlayment formed of a homogeneous layer of a resilient material having a bending stiffness in said top section, so as to prevent significant bending of the underlayment and also providing an effective spring constant to the underlayment that is less than about $8\times10^6$ Pa at 160 Hz.

2. The underlayment of claim 1 wherein said underlayment is made from rubber.

3. The underlayment of claim 1 wherein said underlayment is made from recycled rubber.

4. The underlayment of claim 1 wherein said underlayment is made from synthetic elastomers.

5. The underlayment of claim 1 wherein said underlayment is made from molded material.

6. The underlayment of claim 1 wherein said underlayment is made from an extruded sheet.

7. The underlayment of claim 1 wherein said underlayment is made from a material with sufficient flexural strength to eliminate the need for secondary support or reinforcement.

8. The underlayment of claim 1 formed so as to reduce the underlayment weight up to 46% over an underlayment of equal thickness having a flat top section and a flat bottom section with a substantially continuous layer of material therebetween.

9. The underlayment of claim 1 formed so as to reduce sound transmission by up to 7% over an underlayment of equal thickness having a flat top section and a flat bottom section with a substantially continuous layer of material therebetween.

10. A flooring system which comprises:

a rigid decorative flooring material;

an underlayment having cone shaped protuberances on its bottom section and having said decorative flooring material on its top section;

a poured concrete slab holding said underlayment; wherein the flooring system is for use in buildings to attenuate sound; and said underlayment formed of an homogeneous layer of a resilient material having a bending stiffness in said top section, so as to prevent significant bending of the underlayment and also providing an effective spring constant to the underlayment that is less than about $8\times10^6$ Pa at 160 Hz.

11. The flooring system as in claim 10 where the underlayment is held in place by friction.

12. The flooring system as in claim 10 where the underlayment is held in place by an adhesive layer above and below the underlayment.

13. A flooring system which comprises:

an underlayment having a top section and a bottom section with a plurality of conically-shaped protuberances extending from the bottom section; and a poured concrete slab on which said underlayment is placed such that each conically-shaped protuberances is in contact with said poured concrete slab; wherein said flooring system is for use in buildings to attenuate sound; and said underlayment formed of a homogeneous layer of a resilient material having a bending stiffness in said top section so as to prevent significant bending of the underlayment and also providing an effective spring constant to the underlayment that is less than about $8\times10^6$ Pa at 160 Hz.

14. A flooring system which comprises:

a rigid decorative flooring material;

an underlayment having a top section and bottom section with a plurality of protuberances extending from said bottom section; and a structural subfloor on which said underlayment is placed such that each protuberance is in contact with said structural subfloor;

wherein the flooring system is for use in buildings to attenuate sound; and said underlayment formed of a homogeneous layer of a resilient material having a bending stiffness in said top section so as to prevent significant bending of the underlayment and also providing an effective spring constant to the underlayment that is less than about $8\times10^6$ Pa at 160 Hz.

15. The flooring system as in claim 14 wherein the underlayment is held in place by friction.

16. The flooring system as in claim 14 wherein the underlayment is held in place by an adhesive layer above and below the underlayment.

17. A flooring system which comprises:

an underlayment having a top section and a bottom section with a plurality of protrusions extending from the bottom section, said protrusions having a rounded end for contact with a structured subfloor;

wherein the flooring system is for use in lightweight framed buildings to attenuate sound; and said underlayment formed of a homogeneous layer of a resilient material having a bending stiffness in said top section so as to prevent significant bending of the underlayment and also providing an effective spring constant to the underlayment that is less than about $8\times10^6$ Pa at 160 Hz.

18. The flooring system in claim 17 where the underlayment is held in place by friction.

19. The flooring system in claim 17 where the underlayment is held in place by an adhesive layer above and below the underlayment.

20. A profiled underlayment for a flooring system which includes a subfloor on which the underlayment is placed, said underlayment reducing the transmission of acoustic energy while reducing the total material required, said underlayment comprising:

a homogeneous layer of a resilient material having a top section and a bottom section, said top section being flat and said bottom section being formed with a plurality of protuberances extending therefrom so as to contact an area of said subfloor less than the area of said underlayment; and said homogeneous layer of a resilient material providing a bending stiffness in said top section so as to prevent significant bending of the underlayment, and also providing an effective spring constant to the underlayment that is less than about $8\times10^6$ Pa at 160 Hz.

21. The underlayment of claim 20 wherein a selected number of said protuberances have surfaces no portions of which are coextensive with the sides of said underlayment.

22. The underlayment of claim 20 wherein said underlayment is made from rubber.

23. The underlayment of claim 20 wherein said underlayment is made from recycled rubber.

24. The underlayment of claim 20 wherein said underlayment is made from synthetic elastomers.

25. The underlayment of claim 20 wherein said underlayment is made from molded material.

26. The underlayment of claim 20 wherein said underlayment is made from an extruded sheet.

27. The underlayment of claim 20 wherein said underlayment is formed from a material with sufficient flexural strength to eliminate the need for secondary support or reinforcement.

28. The underlayment of claim 20 wherein said underlayment is formed so as to reduce the underlayment weight up to 46% over an underlayment of equal thickness having a flat top section and a flat bottom section with a substantially continuous layer of material therebetween.

29. The underlayment of claim 20 wherein said underlayment is formed with a cross-sectional profile so as to reduce the underlayment sound transmission up to 7% over an underlayment of equal thickness having a flat top section and a flat bottom section with a substantially continuous layer of material therebetween.

30. A flooring system which comprises:

a rigid decorative flooring material;

an underlayment having a top section and bottom section with a plurality of protuberances extending from said bottom section; and a structural subfloor on which said underlayment is placed such that each protuberance is in contact with said structural subfloor;

wherein the flooring system is for use in buildings to attenuate sound; and said underlayment formed of a homogeneous layer of a resilient material providing a bending stiffness in said top section so as to prevent significant bending of the underlayment, and also providing an effective spring constant to the underlayment that is less than about $8\times10^6$ Pa at 160 Hz.

31. A flooring system which comprises:

a rigid decorative flooring material;

an underlayment having cone shaped protuberances on its bottom section and having said decorative flooring material on its top section;

a poured concrete slab holding said underlayment; wherein the flooring system is for use in buildings to attenuate sound; and said underlayment formed of an homogeneous layer of a resilient material providing a bending stiffness in said top section, so as to prevent significant bending of the underlayment and also providing an effective spring constant to the underlayment that is less than about $8\times10^6$ Pa at 160 Hz.

* * * * *